US005762212A

United States Patent [19]

Pomerantz

[11] Patent Number: 5,762,212

[45] Date of Patent: Jun. 9, 1998

[54] DISPLAY STRIP MERCHANDISER

[76] Inventor: Carl Pomerantz, 567 Lakeshore Blvd., Beaconsfield, Montreal, Que, Canada, H9W4K3

[21] Appl. No.: 702,847

[22] Filed: Aug. 26, 1996

[51] Int. Cl.[6] ..... A47F 7/00

[52] U.S. Cl. ..... 211/113; 206/482; 211/73

[58] Field of Search ..... 211/113, 118, 211/71, 72, 73; 248/225.11, 909; 206/45.24, 482

[56] References Cited

U.S. PATENT DOCUMENTS

| | | | |
|---|---|---|---|
| 454,416 | 6/1891 | Albrecht | 206/482 |
| 1,477,241 | 12/1923 | Carson | 206/482 |
| 1,524,170 | 1/1925 | Carson | 206/482 |
| 4,483,502 | 11/1984 | Fast | 248/222.1 |
| 4,506,787 | 3/1985 | Bruso | 206/482 X |
| 4,718,627 | 1/1988 | Fast et al. | 211/113 X |
| 4,896,852 | 1/1990 | Akema | 248/909 X |
| 5,103,970 | 4/1992 | Nielson et al. | 206/45.14 |
| 5,199,578 | 4/1993 | Pendergraph et al. | 211/72 |
| 5,284,259 | 2/1994 | Conway et al. | 248/225.11 X |
| 5,339,967 | 8/1994 | Valiulis | 211/113 X |
| 5,386,916 | 2/1995 | Valiulis | 211/113 |
| 5,405,022 | 4/1995 | Rissley | 211/59.1 |
| 5,553,721 | 9/1996 | Gebka | 211/118 X |

*Primary Examiner*—Robert W. Gibson, Jr.

*Attorney, Agent, or Firm*—Mila Shvartsman

[57] ABSTRACT

The present invention relates to a display strip merchandiser comprising an item-supporting section adapted to be positioned vertically for display of an item attached to the item-supporting section, and at least one item-attachment member located on the item-supporting section. The item-attachment member has a body portion and at least one head or tip portion. The item-attachment member is connected to the item-supporting section by means of a proximal end of its body portion, and its head or tip portion is located near a distal end of the body portion. The head portion is adapted to be engaged with the item-supporting section for secure attachment of an item on the merchandiser. The item-attachment member is adapted to be engaged to the item-supporting member during display of an item. The item-attachment member is further adapted to be engaged to the item-supporting section during transportation of the merchandiser pre-loaded with an item. The head or tip portion is engaged with the item-supporting section by means of a corresponding recess formed on the item-supporting section; in use, the head portion is anchored or locked within the recess thus facilitating a secure attachment of an item on the merchandiser. The item-supporting section may have a number of item-attachment members, where the item-attachment members are spaced vertically from each other on the item-supporting section. The merchandiser is an integral unit made of flexible plastic.

20 Claims, 3 Drawing Sheets

DISPLAY STRIP MERCHANDISER

This invention is related to a display strip merchandiser, and more particularly to a strip merchandiser providing a secure attachment of a displayed item.

Strip merchandisers, also known as display strips, have been used by retailers for many years to display featured products on a vertical wand or strip beyond the shelf edge. The purpose of this method of display is to highlight the product and encourage impulse or complimentary sales. It also is a way to increase store area usage without using or requiring additional shelf space for displaying these products.

For the strip to function properly, the products must be firmly held in place by the strip so that the strip's fingerlike projections adequately support the products and provide some resistance against the product being accidentally dislodged by a passer-by. As well, the products must be easily removable by a shopper who might wish to purchase the product.

Usually, it is desirable for the strip to be inexpensive since it has a short lifespan, particularly in cases where the product manufacturer ships their product pre-loaded with or on a strip to a store. If the product is pre-loaded onto the strip for shipping, it is important that the product remains attached to the strip during shipping so that at store level, the store clerk can simply hang the strip with the product already attached. If the strip is loaded at store level, it is important that the strip can be easily and quickly loaded with product, yet hold the product securely.

There are generally known in common usage metal strips or wands, injection moulded contoured plastic strips, extruded strips, flat moulded plastic strips, or die cut strips made from flat plastic sheets, strips or cardboard.

The most common strip is the flat variety, since it is most cost effective. Many models of flat strips have been patented and are in common use. Some models, such as U.S. Pat. No. 4,718,627 (J. Fast), or Canadian Patent application 2,103,286 (Valiulis) have patented attachment means for ease of attachment to shelving. Others, such as U.S. Pat. No. 5,386,916 (Valiulis) or U.S. Pat. No. 5,103,570 (Fiskars) feature fold-lines or cuts that enable the strips to be adjusted in length or folded.

For flat strips, however, a common problem is that the hook members are too weak to adequately support the articles displayed, and as a result, the articles are prone to falling off during shipment and during final display.

If the strip is manufactured out of flat material, the thickness of the product is uniform, and therefore the entire strip thickness must be increased in order to achieve stronger support at the base of the support members. U.S. Pat. No. 4,911,392 describes one method of achieving a localized reinforcement arrangement by folds which effectively increase the moment of inertia along the support member.

U.S. Pat. No. 5,103,570 (Fiskars) overcomes the problem of products falling off the strip during shipping by folding the strip in an accordion-like manner. Other methods include threading a strap through a series of holes to effectively strap or tie the product onto the strip during shipping, with the strap being removed at store level.

Canadian patent application 2,082,598 (Pendergraph) uses extending ears to interlock the package with the strip. Although this does provide resistance to the product dislodging during shipping and display, there are a multitude of package hole profiles, and therefore the package hole profile and the extending ears on the strip must be complimentary in size and shape in order for this arrangement to function properly.

U.S. Pat. No. 5,405,022 describes a similar support mechanism, which although effective, necessitates a custom matching of package hole profile to support member profile. As well, the forces on the support members are cantilever forces, and therefore the loading forces on the hook base and the mode of failure by over-flexing is still the same.

The most widely used configuration is to have a W-shape cut into the strip so that the product can be hung on one hook, and then the downward pointing fingers can be overlaid over the product, thereby stabilizing the product in place for shipment, and providing some resistance to dislodgement during display. If products and strip are accidentally knocked or disturbed by a passer-by, the two downward extending fingers help to keep the product from being knocked off. However, as a result, the width of the strip is substantially increased in order to accommodate the two downward fingers.

In order to provide increased falling resistance, thicker material must often be used to provide more rigidity for these hooks to adequately hold these products. In all the above cases, the product, once attached to the strip, is being held in place by a bending or cantilevered hook-like support loading condition. When loaded with a product, the hook is flexed forward and is cantilevered out to support the product. Product falling may occur when the product is accidentally knocked off the hook, or the hook is over-flexed, or the product is moved further away from the base of the hook, thereby over-flexing the hook by increasing the bending moment near the hook base, which increases the deflection of the hook until the product dislodges.

The common W-shape provides some resistance to the product being knocked off the hook only if the direction of the disturbance is substantially vertical and upward. The two finger overlays provide only limited resistance to the product moving further from the base of the hook.

U.S. Pat. No. 4,483,502 (Fast) describes a remote tip portion which can be bent rearwardly to resist the product moving further away from the base of the hook. However, the forces on the hook are still cantilever character forces, and therefore the loading forces on the hook base and the mode of resistance to failure by flexing are still the same. Also in this patent, a bi-winged configuration at the tip of the hook is described, so that the wings can be folded shut, inserted through a package aperture, and then re-opened so that the package can be cantilevered out, but cannot be taken off without folding this bi-winged distal end. Again, this means that the distal end must be specifically matched to the displayed product's hole profile to function properly. As well, the cantilever loading condition forces and resistance to failure of the product are still the same as in other models.

The present invention eliminates all disadvantages of known models and allows secure attachment of displayed items in both situations: during display and during transportation of pre-loaded merchandiser.

SUMMARY OF THE INVENTION

Broadly, the present invention relates to a display strip merchandiser comprising an item-supporting section adapted to be positioned vertically for display of an item attached to said item-supporting section, at least one item-attachment member located on said item-supporting section, said item-attachment member having a body portion and at least one head or tip portion, wherein said item-attachment member is connected to said item-supporting section by means of a proximal end of said body portion, and wherein said head or tip portion being located near a distal end of said body portion, said head portion is adapted to be engaged with said item-supporting section for secure attachment of said item on said merchandiser.

In another embodiment of the present invention, said item-attachment member is adapted to be engaged to said item-supporting member during display of said item, and said item-attachment member is further adapted to be engaged to said item-supporting section during transportation of said merchandiser pre-loaded with said item. Said head or tip portion is engaged with said item-supporting section by means of a corresponding recess formed on said item-supporting section, wherein in use said head portion is anchored or locked within said recess thus facilitating a secure attachment of said item on said merchandiser. Said item-supporting section has a number of said item-attachment members, wherein said item-attachment members are spaced vertically from each other on said item-supporting section, and said merchandiser is an integral unit made of flexible plastic.

In yet another embodiment of the present invention, said item-attachment member is cut out directly into the item-supporting section, and wherein the configuration of said recess formed on said item-supporting section is defined by the configuration of said cut out item-attachment member. Said item-attachment member and said corresponding recess have a configuration of an upwardly pointing arrow, and the head portion of said arrow-shape item-attachment member is securely locked or anchored within a body portion of said arrow-shape recess corresponding to the shape of the body portion of said item-attachment member. Said item-attachment member is adapted to securely lock said item during shipment of said merchandiser pre-loaded with said item; said item is attached to said merchandiser by means of an aperture, and wherein the dimensions of the head portion of said item-attachment member allow to engage a large variety of said apertured items. The width of said head portion is smaller than the width of said aperture to facilitate easy removal of said item from said merchandiser, or said head portion has a cross-shape configuration.

In still another embodiment of the present invention, said item-attachment member has a number of head portions spaced alongside of said body portion, and attachment of said item is provided by means of forward movement of the distal end of said item-attachment member.

BRIEF DESCRIPTION OF THE DRAWINGS

Referring to the attached drawings.

DETAILED DESCRIPTION OF THE PRESENT INVENTION

Figure 1:
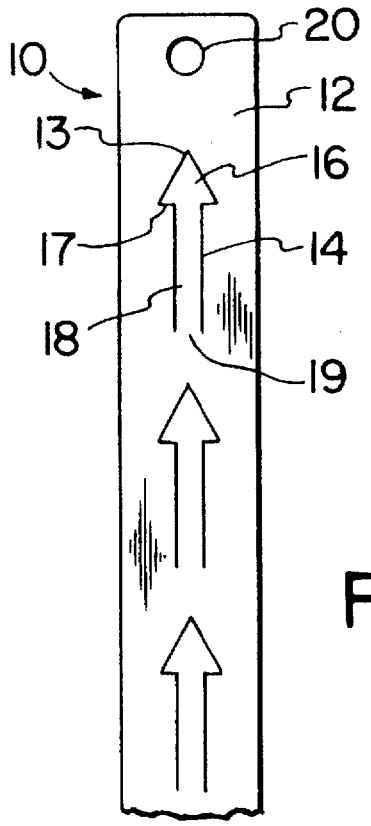
FIG. 1 is the front view of the first embodiment of the present invention.
Figure 2:
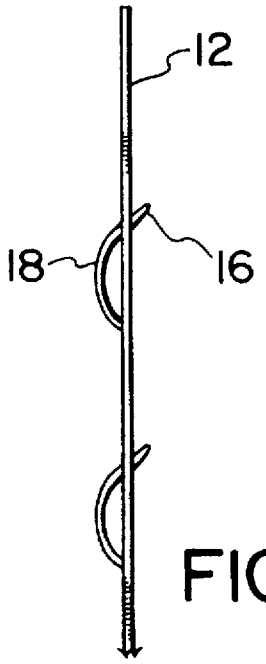
FIG. 2 is a side view of FIG. 1 showing item-attachment members being engaged into the corresponding recesses of the item-supporting section.
Figure 3:
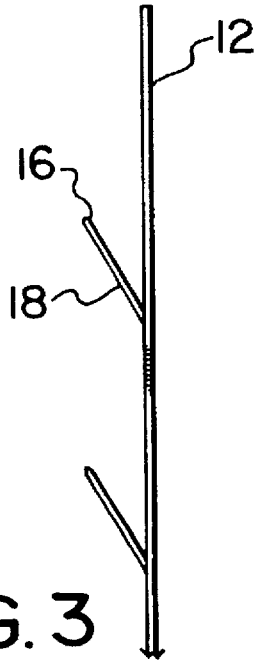
FIG. 3 is a side view of FIG. 1 showing item-attachment members disengaged from the item supporting section.
Figure 4:
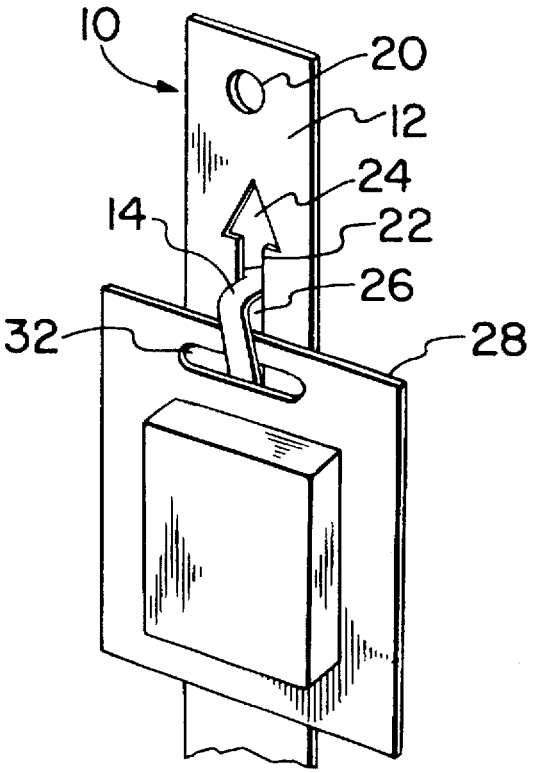
FIG. 4 is a front perspective view of the strip of FIG. 1 in use.
Figure 5:
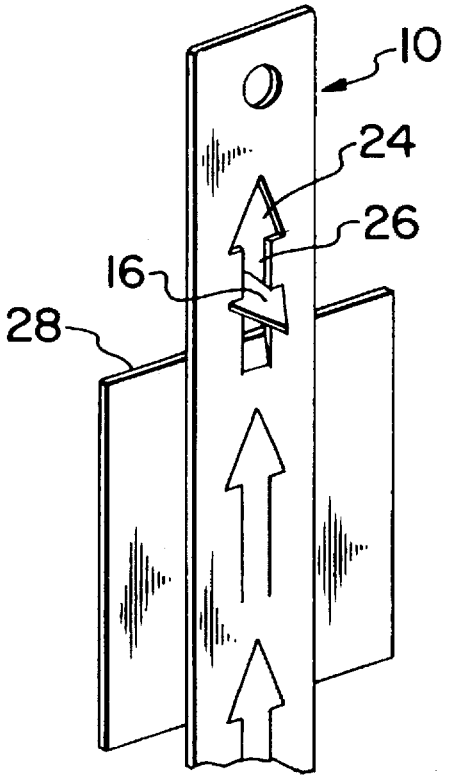
FIG. 5 is a back perspective view of FIG. 4.

Referring to drawings, FIGS. 1–5 show a display strip merchandiser 10 comprising an item-supporting section 12 having a number of item-attachment members 14 spaced alongside of said item-supporting section 12 and spaced vertically from each other on the item-supporting section 12. Each of the item-attachment members comprises a head or tip portion 16 connected to a body portion 18 and located near the distal end of said body portion 18. The item-attachment member 14 is connected to the item-supporting portion 12 by means of a proximal end 19 of said body portion 18. In the first embodiment of the present invention, the item-attachment member 14 has a configuration of an upwardly pointing arrow. The item-supporting section 12 is provided with recesses 22 formed on said item-supporting section 12. The configurations of those recesses 22 is defined by the configuration of the item-attachment members 14. In the first embodiment, those recesses have an upwardly-pointing arrow configuration comprising a head recess 24 and a body recess 26.

In use, the head or tip 16 of the item-attachment members 14 is adapted to be engaged with the item-supporting section 12 by means of recesses 22. In this case, wings 17 of the head 16 are securely locked or anchored within a body portion 26 of the recess 22, thus facilitating a secure attachment of the item 28 on the merchandiser 10. When the merchandiser 10 is suspended in vertical position, displayed items 28 facilitate better locking or engagement of the head 16 within the recess 26 by means of gravity forces sliding head 16 downwardly in the recess 26, thus eliminating any accidental disengagement of the item-attachment member 14 and failure or falling off of the displayed items 28. This is a very important advantage of the present invention. The merchandiser 10 is an integral unit made of flexible material, such as plastic, wood fibre based material and the like. In this case, item-attachment members 14 are cut out directly into the item-supporting section 12.

In view of the fact that the dimensions of the head 16 of the item-attachment member 14 is smaller than the width of the aperture 32 provided on the item 28, it facilitates easy loading or removal of the item from the merchandiser, which is also a substantial advantage of the present invention, since it allows for engagement of a large variety of apertured items.

The design of the merchandiser according to the present invention allows for pre-loading of items for transportation, wherein on the store level, this pre-loaded strip may be immediately placed on display. In this case, item-attachment members 14 remain engaged into the corresponding recesses 22 in both configurations: during transportation of said merchandiser pre-loaded with items, and during display of said items. This is yet another considerable advantage of the present invention.

Figure 8:
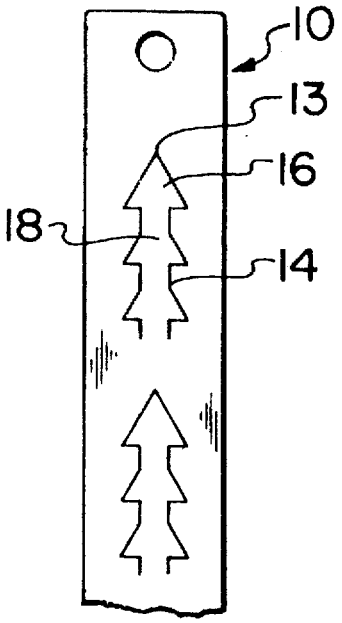
FIG. 8 is a front view of the modification of FIG. 1 showing a number of heads.

The present invention is not restricted to one head 16 located near the distal end of the body portion 14. It is also possible to have a number of heads spaced alongside the body portion 18 as shown on FIG. 8. In operation, the process of attachment of the item 28 to the merchandiser 10 is provided by means of forward movement of the distal end 13 of the item-attachment member 14.

Figure 6:
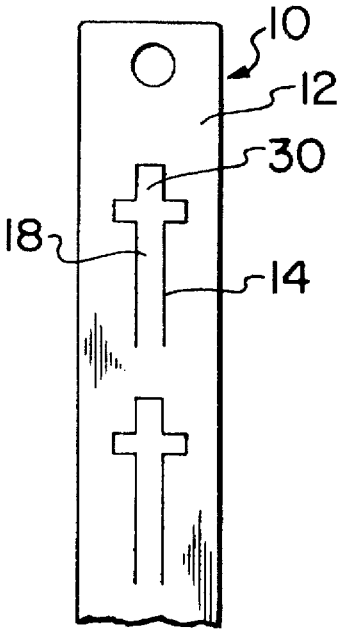
FIG. 6 is a front view of the second embodiment of the present invention.

FIG. 6 shows a second embodiment of the present invention, wherein the item-attachment member 14 has a head portion 30 of cross-shaped configuration. The mode of operation of this embodiment is similar to arrow-head modification.

Figure 9:
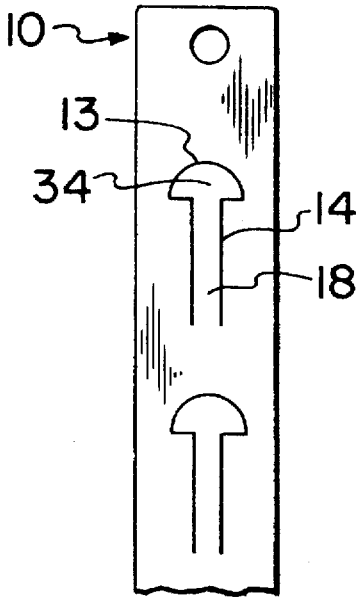
FIG. 9 is a front view of the third embodiment of the present invention.

FIG. 9 shows the third embodiment of the present invention, wherein the item-attachment member 14 has a head portion 34 of semi-circular configuration. The mode of the operation of this embodiment is similar to arrow-head modification.

It is very important to emphasize that the secure locking or anchoring of the item-attachment members on the item-supporting section depends primarily on the fact that the head portion is larger than the corresponding recess; any other similar configuration of the head portion is a possible alternative.

Figure 7:
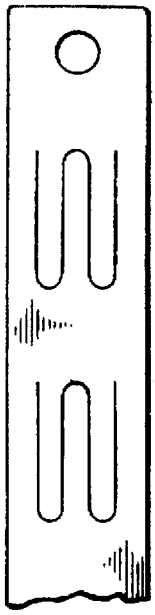
FIG. 7 PRIOR ART
FIG. 7 is prior art.

The present invention provides a more efficient and cost effective use of material by creating a tensile axial load on the item-attachment members 14 which alters the loading condition thereby increasing the member's ability to support and maintain attachment to a product package. In this case, those members are loop-like and attached to the strip 10 at their proximal end, can pass through a displayed product aperture 32, and then loop back and fasten or anchor into the strip above and behind the displayed product (see FIG. 5). As a result of the distal end 13 being anchored within the recess 26, the support of the product is substantially increased versus a common non-distal end anchored finger-like member as on FIG. 7 showing prior art. When a customer wants to remove the package, their natural lifting and twisting motion releases the distal end so that the package is free to slide off the support member.

Unlike common finger-like members which are limited by the materials' flexing strength to resist cantilever forces, the present invention takes better advantage of the materials' structural characteristics by altering the support condition from a pure bending or cantilever type loading condition by adding an axial component of tensile force along the item-attachment member. As a result, resistance to the products' falling is substantially increased with a very efficient use of material.

Besides, this loading condition provides resistance to product falling when the strip or products are inadvertently knocked or disturbed. As well, the strip can be pre-loaded and products remain attached to the strip for shipment to the store.

Unlike other known structures, the shape of the distal end is such that it can pass through a large variety of common apertures and as a result, no specific matching of the strip to products' aperture is necessary. It is also very quick and easy to load products. Further, it can loop and support thick blister carded items or products that tend to pry and over-flex common non-distal end anchored finger-like support members.

Thus, it can be seen that the objects of the present invention have been satisfied by the structure presented hereinabove. While in accordance with the Patent Statutes, only the best mode and preferred embodiments of the present invention has been presented and described in detail, it is to be understood that the invention is not limited thereto or thereby. Accordingly, for an appreciation of the true scope and breadth of the invention, references should be made to the following claims.

I claim:

1. A display strip merchandiser comprising:

an item-supporting section adapted to be positioned vertically for display of a suspended item attached to said item-supporting section, at least one item-attachment member located on said item-supporting section, said item-attachment member having a body portion and at least one head or tip portion, wherein said item-attachment member is connected to said item-supporting section by means of a proximal end of said body portion, said head or tip portion being located near a distal end of said body portion, said head portion is adapted to be engaged with said item-supporting section for secure suspension of said item on said merchandiser;

wherein said head or tip portion is engaged with said item-supporting section by means of a corresponding recess formed on said item-supporting section, said item-attachment member is cut out directly out of the item-supporting section, and the configuration of said recess formed on said item-supporting section is defined by the configuration of said cut-out item-attachment member;

wherein the width of said recess near the proximal end of said body portion is smaller than the width of said head portion thus facilitating secure anchoring or locking of said head portion within said recess, wherein in use said head portion is securely locked in position by the weight of the item suspended on said item-attachment member.

2. A display strip merchandiser according to claim 1, wherein said item-attachment member is adapted to be engaged to said item-supporting member during display of said item.

3. A display strip merchandiser according to claim 2, wherein said item-attachment member is further adapted to be engaged to said item-supporting section during transportation of said merchandiser pre-loaded with said item.

4. A display strip merchandiser according to claim 1, wherein said item-supporting section has a number of said item-attachment members, wherein said item-attachment members are spaced vertically with respect to each other on said item-supporting section in such a way that the proximal end of any preceding item-attachment member does not overlap with the head portion of any of the following item-attachment member.

5. A display strip merchandiser according to claim 1, wherein said merchandiser is an integral unit made of flexible plastic.

6. A display strip merchandiser according to claim 1, wherein the width of the body portion of said item-attachment member is uniform.

7. A display strip merchandiser according to claim 6, wherein said item-attachment member and said corresponding recess have a configuration of an upwardly pointing arrow.

8. A display strip merchandiser according to claim 7, wherein the head portion of said arrow-shape item-attachment member is securely locked or anchored within a body portion of said arrow-shape recess corresponding to the shape of the body portion of said item-attachment member.

9. A display strip merchandiser according to claim 1, wherein said item-attachment member is adapted to securely lock said item during shipment of said merchandiser pre-loaded with said item.

10. A display strip merchandiser according to claim 1, wherein said item is attached to said merchandiser by means of an aperture, and wherein the dimensions of the head portion of said item-attachment member allow to engage a large variety of said apertured items.

11. A display strip merchandiser according to claim 10, wherein the width of said head portion is smaller than the width of said aperture to facilitate easy removal of said item from said merchandiser.

12. A display strip merchandiser according to claim 6, wherein said head portion having a cross-shape configuration.

13. A display strip merchandiser according to claim 1, wherein said item-attachment member has a number of head portions spaced alongside of said body portion.

14. A display strip merchandiser according to claim 1, wherein suspension of said item is provided by means of forward movement of the distal end of said item-attachment member; wherein said item is suspended below the proximal end of said item-attachment member.

15. A display strip merchandiser comprising an item-supporting section adapted to be positioned vertically, a plurality of item-attachment members located on said item-supporting section, wherein each of said item-attachment members has a body portion and a head or tip portion, said item-attachment members being connected to said item-supporting section by means of a proximal end of said body portion, said head or tip portion is located near a distal end of said body portion, said head portion is adapted to be engaged with said item-supporting section for secure suspension of a plurality of display items mounted on said merchandiser;

wherein said head or tip portion is engaged with said item-supporting section by means of a corresponding recess formed on said item-supporting section, said item-attachment member is cut out directly out of the item-supporting section, and the configuration of said recess formed on said item-supporting section is defined by the configuration of said cut out item-attachment member;

wherein the width of said recess near the proximal end of said body portion is smaller that the width of said head portion thus facilitating secure anchoring or locking of said head portion within said recess, wherein in use said head portion is locked in the position by weight of the item suspended on said item-attachment member.

16. A display strip merchandiser according to claim 15, wherein said item-attachment members are adapted to be engaged to said item-supporting section during display of said item.

17. A display strip merchandiser according to claim 16, wherein said item-attachment members are further adapted to be engaged to said item-supporting section during transportation of said merchandiser pre-loaded with said items.

18. A display strip merchandiser according to claim 1, wherein said merchandiser is made from wood fibre based material, such as cardboard.

19. A display strip merchandiser according to claim 6, wherein said head portion has a semicircular configuration.

20. A display strip merchandiser according to claim 15, wherein said item-attachment members are spaced vertically with respect to each other on said item-supporting section in such a way that the proximal end of any preceding item-attachment member does not overlap with the head portion of any of the following item-attachment member.

* * * * *